United States Patent [19]

Corna et al.

[11] 4,179,761

[45] Dec. 25, 1979

[54] WALL CONSTRUCTION FOR SWIMMING POOLS

[76] Inventors: John F. Corna, 1542 N. Crest Ave., Columbus, Ohio 43220; Marcel H. Blais, 8085 Manitou Dr., Westerville, Ohio 43081

[21] Appl. No.: 918,793

[22] Filed: Jun. 26, 1978

[51] Int. Cl.[2] ..... E04H 3/16; E04H 3/18

[52] U.S. Cl. ..... 4/172.19; 4/172.17; 52/169.5; 210/169

[58] Field of Search ..... 4/172.19, 172.17, 172.18, 4/172.15; 52/169.5, 169.1; 210/169

[56] References Cited

U.S. PATENT DOCUMENTS

| | | | |
|---|---|---|---|
| 3,059,243 | 10/1962 | Ross et al. | 4/172.19 |
| 3,298,038 | 1/1967 | O'Connell et al. | 4/172.19 |
| 3,432,867 | 3/1969 | Whitten, Jr. | 4/172.17 |
| 3,579,665 | 5/1971 | Barker | 4/172.19 |
| 3,641,595 | 2/1972 | Viessmann | 4/172.19 |
| 3,890,230 | 6/1975 | Patterson | 4/172.17 X |
| 3,923,230 | 12/1975 | Patterson et al. | 4/172.17 X |
| 3,938,199 | 2/1976 | Laven | 4/172.19 |
| 4,059,856 | 11/1977 | Patterson | 4/172.17 |
| 4,133,058 | 1/1979 | Baker | 4/172.17 |
| 4,133,059 | 1/1979 | Baker | 4/172.17 |

*Primary Examiner*—Henry K. Artis

[57] ABSTRACT

A wall construction for swimming pools, and method of making same, wherein the pool wall, the recirculating system, gutter and conduit, the bottom wall seal, and the deck coping are all formed from four standardized sheet metal members. The capacity of the gutter and recirculating system can be selectively established, when the components are welded together without varying the dimensions of two main components. Also, the water line to pool deck distance can be selectively established during fabrication without dimensional variation of the two main components.

6 Claims, 3 Drawing Figures

WALL CONSTRUCTION FOR SWIMMING POOLS

BACKGROUND OF THE INVENTION

This invention relates to wall constructions for swimming pools and more particularly to a pool wall wherein the recirculating system and other components are fabricated from standardized sheet metal components, and wherein the capacity of the recirculating system as well as the water level to deck distance can be selectively established during fabrication without dimensional variation of two main components.

PROBLEMS IN THE ART

It is the present practice in the art to fabricate swimming pools, and particularly the larger commercial types, with the wall sections, recirculating system, gutters and conduits, and the deck copings from stainless steel sheet metal components. Examples of such constructions are shown in U.S. Pat. Nos. 3,890,230 and 3,923,230 to Patterson.

A problem has been present in such prior pool construction, in that the sheet metal components must be custom shaped and dimensional for each particular job requirement, thus precluding the fabrication of such metal pools from standardized components.

SUMMARY OF THE INVENTION

In general, the present invention comprises a novel pool wall construction, wherein standardized sheet metal components are uniquely shaped, such that the components can be selectively assembled to obtain various capacities for the recirculating system without dimensional variation in the two main components of the assembly.

As another aspect of the invention, the standardized sheet metal components are of a unique configuration, whereby the components can be selectively assembled to obtain various height differentials between the water level and the pool deck elevation.

As another aspect of the present invention, the novel pool construction of the present invention comprises a standardized main sheet metal component that serves the multiple functions of a gutter top edge and inner wall, conduit inner wall, wall face, and bottom seal.

As another aspect of the present invention, the novel pool wall construction comprises a second standard main sheet metal component that serves the multiple functions of outer side and bottom walls of the gutter and recirculating conduit.

As still another aspect of the present invention, the novel pool wall construction comprises another standard sheet metal component of simple construction that serves the multiple functions of deck coping, as well as means for establishing the height differential between the water line and the deck elevation, without any dimensional changes in the two standard main components mentioned above.

As still another aspect of the present invention, the novel pool wall construction comprises another standard sheet metal component of simple construction that can easily varied in dimension to establish the rate of flow of filtered water to the pool. This is accomplished without any dimensional changes in any of the above mentioned standard components.

It is another aspect of the present invention, to provide a novel pool wall construction wherein all components are welded together to form a monolithic unit with none of the welds exposed to view on the finished pool wall side. As a result the need for grinding and polishing of welds is eliminated, and simple and inexpensive welding techniques can be used.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
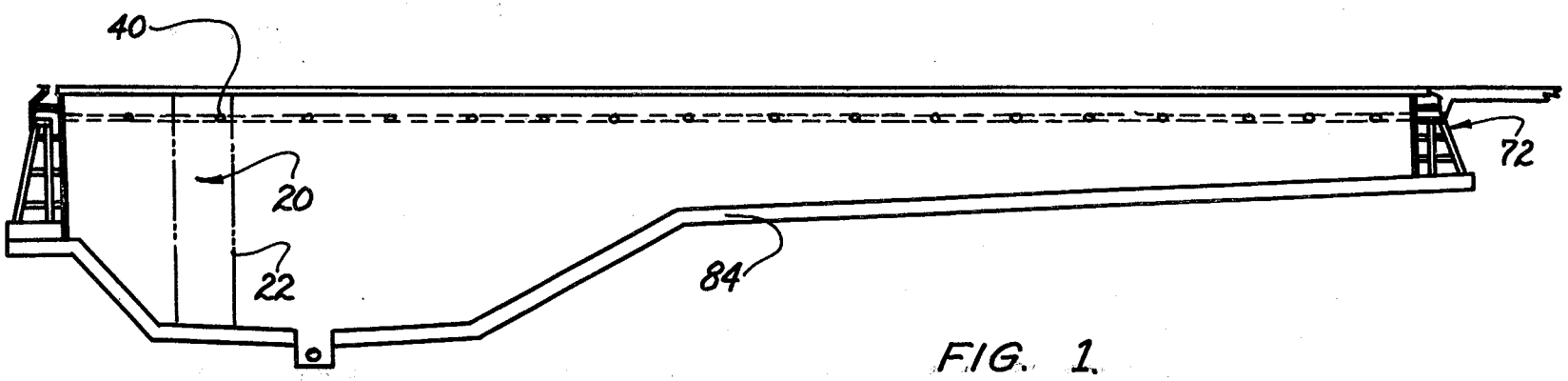
FIG. 1 is a side sectional view, a swimming pool constructed in accordance with the present invention, the section being taken along a vertical plane through the longitudenal center line of the pool.

Referring in detail to the drawings, FIG. 1 illustrates a typical swimming pool constructed in accordance with the present invention, with the walls of the pool being constructed of a plurality of wall forming sections 20 welded together in edge to edge relationship at vertical welded junctions 22.

Figure 2:
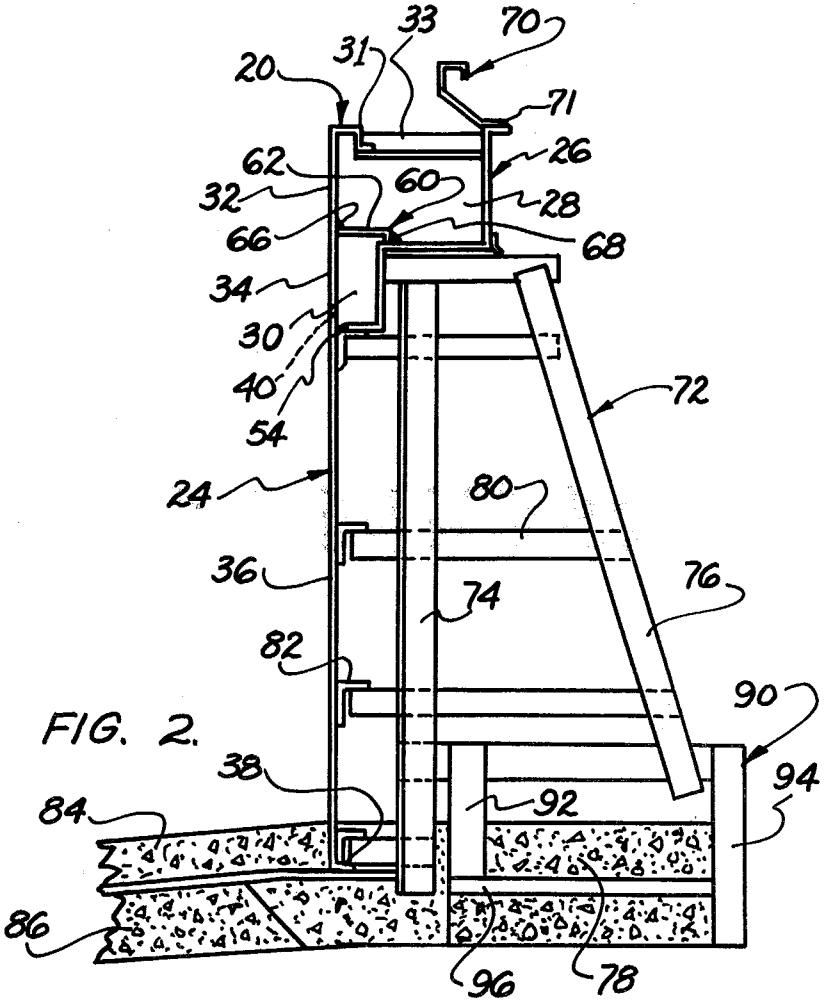
FIG. 2 is a side elevational view of a pool wall section constructed in accordance with the present invention.
Figure 3:
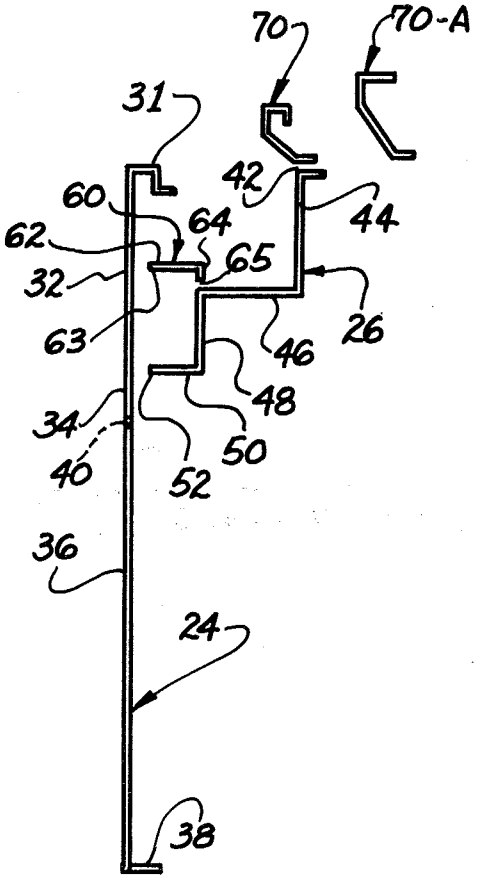
FIG. 3 is an exploded view of the pool wall section of FIG. 3.

Each of the sections 20 comprises an assembly of stainless steel sheet metal components which components are welded together to form a standard monolithic pool wall section, as shown in detail in FIG. 2 and 3.

The assembled section 20 consists of two main standard components which need never be dimensionally varied, and two secondary standard components that require minor variations in their height dimension only, and can be made up in several standard sizes and stocked in inventory if desired, so as to be in a position to handle all job requirements from a standardized inventory of prefabricated parts.

Referring to FIGS. 2 and 3, one of the standard main components comprises a first sheet metal member indicated generally at 24 which member provides the entire pool wall face and is fabricated from a single continuous sheet of stainless steel stock 48 inches high and 120 inches wide.

The other standard main component, which is never dimensionally varied, comprises a second sheet metal member indicated generally at 26 which member forms the outer side walls and bottom walls of both a water return gutter 28 and a filtered water supply conduit 31. Such gutter and conduit comprise portions of the recirculating system the other components of which are conventional and hence not illustrated herein.

As seen in FIGS. 2 and 3, the first main component 24 includes a horizontally inturned upper edge that forms a gutter inlet 31; an upper first sheet portion 32 forming a gutter inner wall, an intermediate first sheet portion 34 forming a conduit inner wall, a lower first sheet portion 36 forming the majority of the pool face, and a horizontal outturned flange 38 that is adapted to form a bottom seal.

The first main component 24 is also provided with one or more outlet orifices 40 which communicate with the interior of filtered water conduit 30 and thereby provide means for returning the filtered water to the pool.

Reference is next made to the second main component 26 which consists of a second sheet top edge 42, a gutter outer wall 44, a gutter bottom wall 46, a conduit outer wall 48, a conduit bottom wall 50 and an inner edge 52 that is joined to the first main sheet metal member 24 at a lower inner welded junction 54 as shown in FIG. 2.

Reference is next made to a secondary component indicated generally at 60 which includes a horizontally extending third sheet portion 62 that forms the conduit top wall and a portion of the gutter bottom wall. A downturned vertically extending third sheet portion 64 may be varied in height in order to establish the flow capacity of conduit 30, and an inner edge 63 is joined to first component 24 at an upper inner welded junction 66. The outer edge 65 is joined to the second main component 26 at an upper outer welded junction 68 as shown in FIG. 3.

Another secondary component of the assembly comprises a fourth sheet metal member indicated generally at 70 and serves as the deck coping for a poured deck of concrete or other selected deck material. In addition, fourth sheet metal member 70 also provides means for establishing the deck to water level distance, by merely selecting another member of different height, such as 70-A shown in FIG. 3. This feature eliminates the need to vary the dimensions of any of the other sheet metal members. A lower edge 71 of secondary component 70 is joined to the top edge 42 of the second main component 26 at a horizontal coping weld 71.

With reference to FIG. 3, the assembled wall sections are mounted on a welded steel frame indicated generally at 72 which frame comprises upright frame members 74 and 76 the lower ends of which are supported by a poured footer 78. Frame 72 further includes horizontal frame members 80 the inner ends of which are cantilevered to receive the stringers 82.

Referring again to FIG. 3, a concrete pool bottom 84 is poured over a gravel bed 86 with the previously mentioned flange on the bottom of the main component 24 being imbedded in the concrete around the periphery of the pool, when the bottom is poured.

It should be mentioned that gutter 28 may be provided with a removeable perforated cover 33 which rests on small cover supports extended across the top of the gutter. In operation, the capacity of gutter 28 can be established during assembly by selecting the vertical location of the two inner welded junctions 54 and 66 with respect to inner gutter edge 30. This is accomplished without dimensional variation in main components 24 and 26.

The capacity of filtered water conduit 30 can also be established without dimensional variations in any of the other components, merely by selecting a secondary member 60 having the correct height for the desired cross-sectional area for the conduit.

The deck to water level height is also established during fabrication of the wall sections by selecting a secondary member 70 of required height and this is done without any dimensional variations in the other standard components.

It will be noted that all of the horizontal welded junctions are confined to the outer side of the first main component 24 and hence are hidden from the pool face side. Hence, the welding can be done by simple welding techniques without the requirements of grinding and polishing. This contributes greatly to the appearance and economy of fabrication of the pool structure.

While the form of embodiment shown and described constitutes preferred forms, it is to be understood that other forms might be adopted falling within the scope of the claims that follow:

What is claimed is:

1. A wall construction for swimming pools comprising, in combination, a plurality of wall forming sections, joined in edge to edge relationship to form the peripheral wall of the pool, each of the sections comprising a first sheet member serially including a horizontally extending top edge portion forming a gutter inlet, an upper first sheet portion, forming a gutter inner wall, an intermediate first sheet portion forming a conduit inner wall, a lower first sheet portion, and a bottom edge portion forming a wall seal portion; a second sheet member serially including a horizontally extending second sheet member serially including a horizontally extending second sheet top edge, a gutter outer wall, a gutter bottom wall, a conduit outer wall, and a horizontally extending second sheet, inner edge joined to the first sheet member at a lower inner welded junction; and a third sheet member serially including a third sheet inner edge joined to the first sheet member at an upper inner welded junction, a horizontally extending third sheet portion forming a conduit top wall for a recirculating conduit and a portion of the gutter bottom wall, and a third sheet outer edge joined to the second sheet member at an upper outer welded junction, said lower and upper inner welded junctions being selectively positionable at various vertical locations on the first sheet member to vary the height of the gutter inner wall and thereby establish the capacity of the gutter.

2. The wall construction defined in claim 1, wherein said third sheet member includes a vertically extending third sheet portion between said horizontally extending third sheet portion and the third sheet outer edge, the capacity of a recirculating conduit formed by said conduit walls being selectively established by varying the height of said third sheet portion.

3. A wall construction for swimming pools comprising, in combination, a plurality of wall forming sections, joined in edge to edge relationship to form the peripheral wall of the pool, each of the sections comprising a first sheet member serially including a horizontally extending top edge portion forming a gutter inlet, an upper first sheet portion, forming a gutter inner wall, an intermediate first sheet portion forming a conduit inner wall, a lower first sheet portion, and a horizontally extending bottom edge portion forming a bottom wall seal portion; a second sheet member serially including a horizontally extending second sheet top edge, a gutter outer wall, a gutter bottom wall, a conduit outer wall, and a conduit bottom wall, and a horizontally extending second sheet inner edge joined to the first sheet member at a lower inner welded junction; and a third sheet member serially including a third sheet inner edge joined to the first sheet member at an upper inner welded junction, a horizontally extending third sheet portion forming a conduit top wall and a portion of the gutter bottom wall, a third sheet outer edge joined to the second sheet member at an upper outer welded junction; and a fourth sheet member including a horizontally extending fourth sheet top portion forming a finish edging for the deck of the pool and a fourth sheet bottom edge joined to said second sheet top edge, the water line to pool deck distance being selectively established by varying the height dimension of said fourth sheet member without any changes in the other component.

4. The wall construction defined in claim 3, wherein said third sheet member includes a vertically extending third sheet portion between said horizontally extending third sheet portion and the third sheet outer edge, the capacity of a recirculating conduit formed by said conduit walls being selectively established by varying the height of said third sheet portion.

5. A wall, gutter and recirculation conduit construction for swimming pools comprising, in combination a first sheet metal member including an inner side facing the interior of the pool and an outer side; a second sheet metal member including serially arranged flanges forming a gutter outer wall, a gutter bottom wall, a conduit outer wall, a conduit bottom wall, and a lower edge, said lower edge being welded to said outer side of the first member with said walls of the second member spaced from said outer side to form therewith a gutter and the sides and bottom of a recirculating conduit and a third sheet metal member extended between said first and second members and forming a closure for said conduit.

6. A wall, gutter and recirculation conduit construction for swimming pools comprising, in combination, a first sheet metal member including an inner side facing the interior of the pool and an outer side; a second sheet metal member including serially arranged flanges forming a gutter outer wall portion, a gutter bottom wall portion and an inner edge, said inner edge being welded to said outer side of the first member with said wall portions of the second member being spaced from said outer side to form therewith a pool face, gutter and conduit assembly and a third sheet metal member welded to said construction and forming a closure for said conduit, said second sheet member being selectively positionable at various vertical locations on said outer side to vary the capacity of said gutter.

* * * * *